US009478916B2

(12) United States Patent
Kao et al.

(10) Patent No.: US 9,478,916 B2
(45) Date of Patent: Oct. 25, 2016

(54) ELECTRICAL PLUG CONNECTOR

(71) Applicant: ADVANCED-CONNECTEK INC., New Taipei (TW)

(72) Inventors: Ya-Fen Kao, New Taipei (TW); Yu-Lun Tsai, New Taipei (TW); Pin-Yuan Hou, New Taipei (TW); Chung-Fu Liao, New Taipei (TW); Wen-Hsien Tsai, New Taipei (TW); Alan MacDougall, New Taipei (TW)

(73) Assignee: ADVANCED-CONNECTEK INC., Hsin-Tien, New Taipei (YE)

( * ) Notice: Subject to any disclaimer, the term of this patent is extended or adjusted under 35 U.S.C. 154(b) by 0 days.

(21) Appl. No.: 14/755,337

(22) Filed: Jun. 30, 2015

(65) Prior Publication Data

US 2015/0380869 A1 Dec. 31, 2015

(30) Foreign Application Priority Data

| | | |
|---|---|---|
| Jun. 30, 2014 | (TW) | 103211623 A |
| Jul. 8, 2014 | (TW) | 103123539 A |
| Nov. 27, 2014 | (TW) | 103141240 A |

(51) Int. Cl.

| | |
|---|---|
| ***H01R 13/658*** | (2011.01) |
| ***H01R 13/6593*** | (2011.01) |
| *H01R 24/60* | (2011.01) |
| *H01R 107/00* | (2006.01) |
| *H01R 13/6595* | (2011.01) |
| *H01R 13/66* | (2006.01) |

(52) U.S. Cl.

CPC ..... *H01R 13/6593* (2013.01); *H01R 13/6595* (2013.01); *H01R 13/6658* (2013.01); *H01R 24/60* (2013.01); *H01R 2107/00* (2013.01)

(58) Field of Classification Search

CPC ..... H01R 23/6873; H01R 13/65802; H01R 23/7073; H01R 13/658

See application file for complete search history.

(56) References Cited

U.S. PATENT DOCUMENTS

| | | | | |
|---|---|---|---|---|
| 6,210,226 | B1 * | 4/2001 | Zhu | H01R 24/64 439/607.4 |
| 6,986,681 | B2 * | 1/2006 | Tsai | H01R 23/6873 439/607.36 |
| 7,410,366 | B2 * | 8/2008 | Wu | H01R 13/6658 439/660 |
| 7,811,131 | B2 * | 10/2010 | Wang | H01R 13/65802 439/607.35 |

(Continued)

*Primary Examiner* — Gary Paumen

(74) *Attorney, Agent, or Firm* — Muncy, Geissler, Olds & Lowe, P.C.

(57) ABSTRACT

An electrical plug connector includes an insulated housing, and a metallic shell. The insulated housing includes a base member, an upper portion, a lower portion and a mating room between the upper portion and the lower portion. The base member includes a plurality of recessed portions. The upper and lower portions are extending from one side of the base member. The metallic shell encloses the insulated housing, and the metallic shell includes a rear case body and a front case body. The base member is inside the rear case body. The front case body is drawn from the rear case body to be formed at a front side of the rear case body. The front case body protrudes from the front side of the rear case body. The front case body defines a receiving cavity therein to dispose the upper portion and the lower portion.

19 Claims, 13 Drawing Sheets

(56) References Cited

U.S. PATENT DOCUMENTS 7,922,535 B1 * 4/2011 Jiang ..... H01R 13/5205 439/271
7,931,501 B1 * 4/2011 Chiang ..... H01R 12/724 439/607.01
8,282,417 B2 * 10/2012 Xiao ..... H01R 13/648 439/607.36
8,568,173 B2 * 10/2013 Wu ..... H01R 13/502 439/607.56
8,696,385 B2 * 4/2014 Wu ..... H01R 13/6581 439/607.56
8,974,249 B2 * 3/2015 Zhang ..... H01R 12/724 439/607.4
2009/0325417 A1 * 12/2009 Ko ..... H01R 4/023 439/350
2011/0281464 A1 * 11/2011 Hou ..... H01R 13/6593 439/607.55
2013/0040493 A1 * 2/2013 Wu ..... H01R 13/6581 439/607.55
2013/0203290 A1 * 8/2013 Zhang ..... H01R 12/724 439/607.36
2015/0050837 A1 * 2/2015 Wu ..... H01R 13/6463 439/607.55
2015/0111430 A1 * 4/2015 Kao ..... H01R 24/60 439/607.55
2015/0222059 A1 * 8/2015 Little ..... H01R 13/6587 439/607.55
2015/0255905 A1 * 9/2015 Little ..... H01R 13/6658 439/78
2015/0303622 A1 * 10/2015 Tao ..... H01R 13/6581 439/607.55

* cited by examiner

| | | | | | | | | | | | |
|---|---|---|---|---|---|---|---|---|---|---|---|
| GND | RX2+ | RX2− | VBUS | RFU | D− | D+ | CC1 | VBUS | TX1− | TX1+ | GND |
| GND | TX2+ | TX2− | VBUS | CC2 | D+ | D− | RFU | VBUS | RX1− | RX1+ | GND |

21

22

Fig. 1C

ELECTRICAL PLUG CONNECTOR

CROSS-REFERENCES TO RELATED APPLICATIONS

This non-provisional application claims priority under 35 U.S.C. §119(a) on Patent Application No. 103211623, 103123539, and 103141240, filed in Taiwan, R.O.C. on Jun. 30, 2014, Jul. 8, 2014, and Nov. 27, 2014, the entire contents of which are hereby incorporated by reference.

FIELD OF THE INVENTION

The instant disclosure relates to an electrical connector, and more particularly to an electrical plug connector.

BACKGROUND

Generally, Universal Serial Bus (USB) is a serial bus standard to the PC architecture with a focus on computer interface, consumer and productivity applications. The existing Universal Serial Bus (USB) interconnects have the attributes of plug-and-play and ease of use, from the end user's point of view. Now, as technology innovation marches forward, new kinds of devices, media formats and large inexpensive storage products are converging. They require significantly more bus bandwidth to maintain the interactive experience that users have come to expect. In addition, user applications demand a higher performance between the PC and sophisticated peripherals. The transmission rate of USB 2.0 is insufficient. Consequently, faster serial bus interfaces, such as USB 3.0, have been developed to address the need by adding a higher transmission rate to match usage patterns and devices.

An existing USB electrical plug connector includes an insulated housing and a metallic shell, and the metallic shell encloses the insulated housing to provide a shielding effect for signal transmission.

However, a metallic shell of a general USB electrical plug connector is formed through a bending process, which may form a gap (or called a crack) on the metallic shell, and the crack being formed on the metallic shell results in a problem of an undesirable shielding effect. That is, during signal transmission through a USB electrical plug connector, a signal disperses and leaks from the crack, resulting in problems of electromagnetic interference (EMI) and radio frequency interference (RFI). Therefore, how to solve the problems of the conventional structure is a question that related manufacturers must think about.

SUMMARY OF THE INVENTION

In view of the above problems, an exemplary embodiment of the instant disclosure provides an electrical plug connector, which comprises an insulated housing, a plurality of upper-row plug terminals, a plurality of lower-row plug terminals, and a metallic shell. The insulated housing comprises a base member and defines a mating room between an upper portion and a lower portion. The base member comprises a plurality of recessed portions, the upper portion and the lower portion are extending from one side of the base member. The upper portion has an upper mating face, the lower portion has a lower mating face, and the upper mating face is opposite to the lower mating face. The upper-row plug terminals are held in the upper portion. The upper-row plug terminals comprise a plurality of signal terminals, at least one power terminal, and at least one ground terminal, and each of the upper-row plug terminals is held in the upper portion of the insulated housing and disposed at the upper mating face of the upper portion. The lower-row plug terminals are held in the lower portion and each partly projects into the mating room. The lower-row plug terminals comprise a plurality of signal terminals, at least one power terminal, and at least one ground terminal, and each of the lower-row plug terminals is held in the lower portion of the insulated housing and disposed at the lower mating face of the lower portion. The metallic shell encloses the insulated housing and comprises a rear case body and a front case body. The base member is inside the rear case body. The front case body is formed at a front side of the rear case body by deep drawing technique, and the front case body is protruded from the front side of the rear case body. The front case body defines a receiving cavity therein to dispose the upper portion and the lower portion.

In conclusion, in embodiments of the instant disclosure, a front case body is formed at a front side of a rear case body by deep drawing technique, and the front case body is formed as a seamless hollow shell. The front case body can be molded and manufactured through blanking and bending. The structure of the front case body does not have any crack, so that the appearance of the front case body is seamless to improve the beauty of the metallic shell. In addition, the front case body is formed as a seamless hollow shell, making that the structure of the front case body be devoid of cracks, so that the problem of undesirable shielding effect caused by cracks can be avoided, problems of electromagnetic interference (EMI) and radiofrequency interference (RFI) are reduced, and the problem of poor shielding performance is further improved. Moreover, since the front case body is a seamless hollow shell, the structural strength can be increased, and a misalignment problem of the metallic shell may be effectively prevented when the electrical plug connector is being plugged in an electrical receptacle connector. In addition, two clamping sidewalls at two sides of the rear case body is electrically connected to a circuit board for effective conduction and grounded, so as to mitigate the problems of EMI and RFI. Furthermore, pin-assignments of the upper-row plug terminals and the lower-row plug terminals are 180 degree symmetrical, dual or double orientation design which enable the electrical plug connector to be inserted into an electrical receptacle connector in either of two intuitive orientations, i.e. In either upside-up or upside-down directions. In other words, the pin-assignments of the upper-row plug terminals and the lower-row plug terminals have 180 degree symmetrical, dual or double orientation design with respect to a central point of the receiving cavity as the symmetrical center. Consequently, the electrical plug connector is inserted into an electrical receptacle connector with a first orientation where the upper portion is facing up, for transmitting first signals; conversely, the electrical plug connector is inserted into the electrical receptacle connector with a second orientation where the upper portion is facing down, for transmitting second signals. Furthermore, the specification for transmitting the first signals is conformed to the specification for transmitting the second signals. Consequently, the inserting orientation of the electrical plug connector is not limited.

Detailed description of the characteristics and the advantages of the disclosure is shown in the following embodiments, the technical content and the implementation of the disclosure should be readily apparent to any person skilled in the art from the detailed description, and the purposes and the advantages of the disclosure should be readily understood by any person skilled in the art with reference to content, claims and drawings in the disclosure.

BRIEF DESCRIPTION OF THE DRAWINGS

The disclosure will become more fully understood from the detailed description given herein below for illustration only, and thus are not limitative of the disclosure, and wherein:

FIG. 1C is a schematic configuration diagram of plug terminals of the electrical plug connector shown in FIG. 1B;

DETAILED DESCRIPTION

Figure 1:
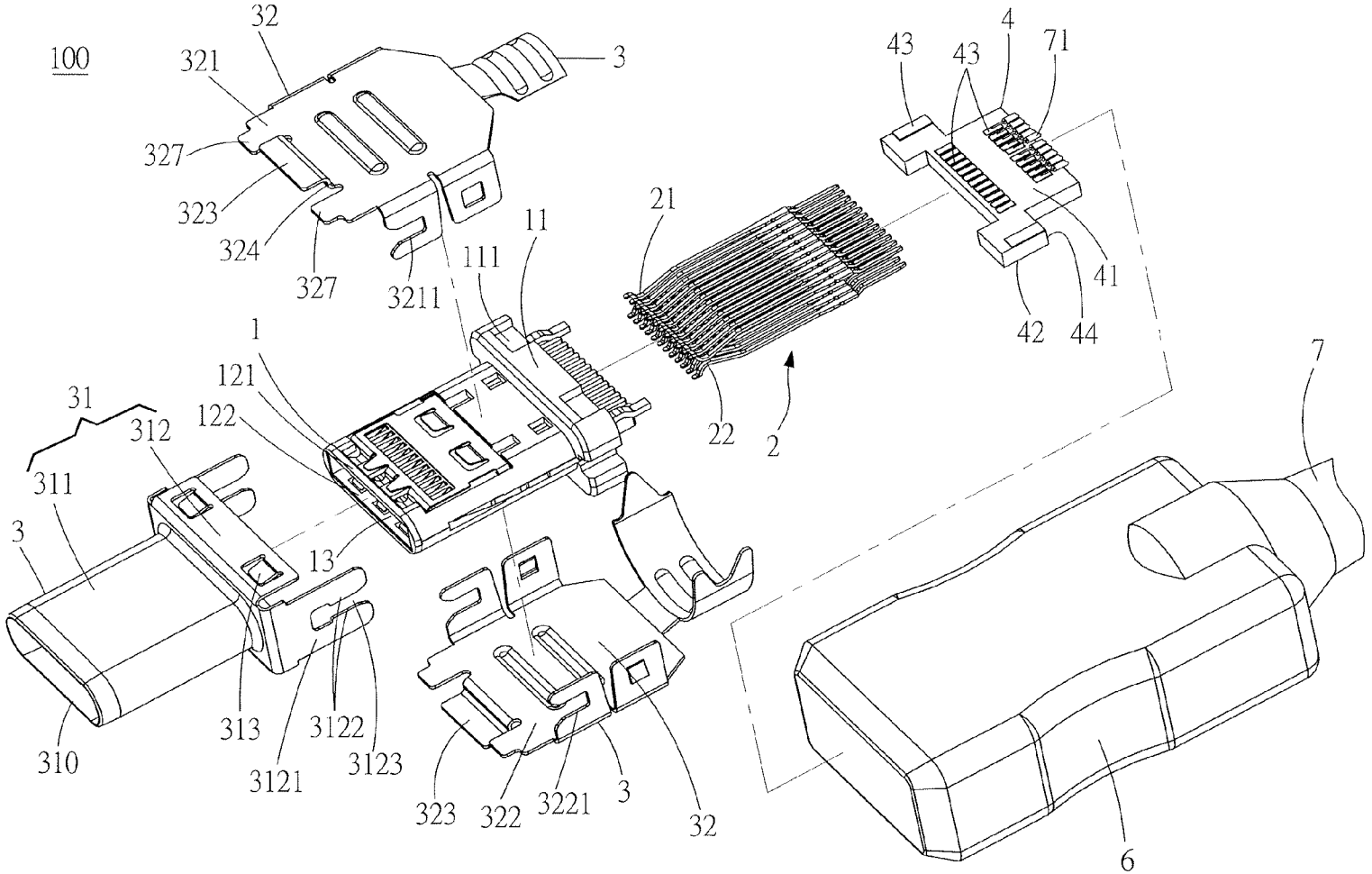
FIG. 1 is an exploded perspective view of an electrical plug connector according to the instant disclosure.

FIG. 1 is an exploded perspective view of an electrical plug connector 100 according to the instant disclosure. FIG. 1 illustrates an exemplary embodiment of the electrical plug connector 100 according to the instant disclosure. In this embodiment, the electrical plug connector 100 provides a USB Type-C connection interface. The electrical plug connector 100 comprises an insulated housing 1, a plurality of plug terminals 2, and a metallic shell 3.

Figure 9:
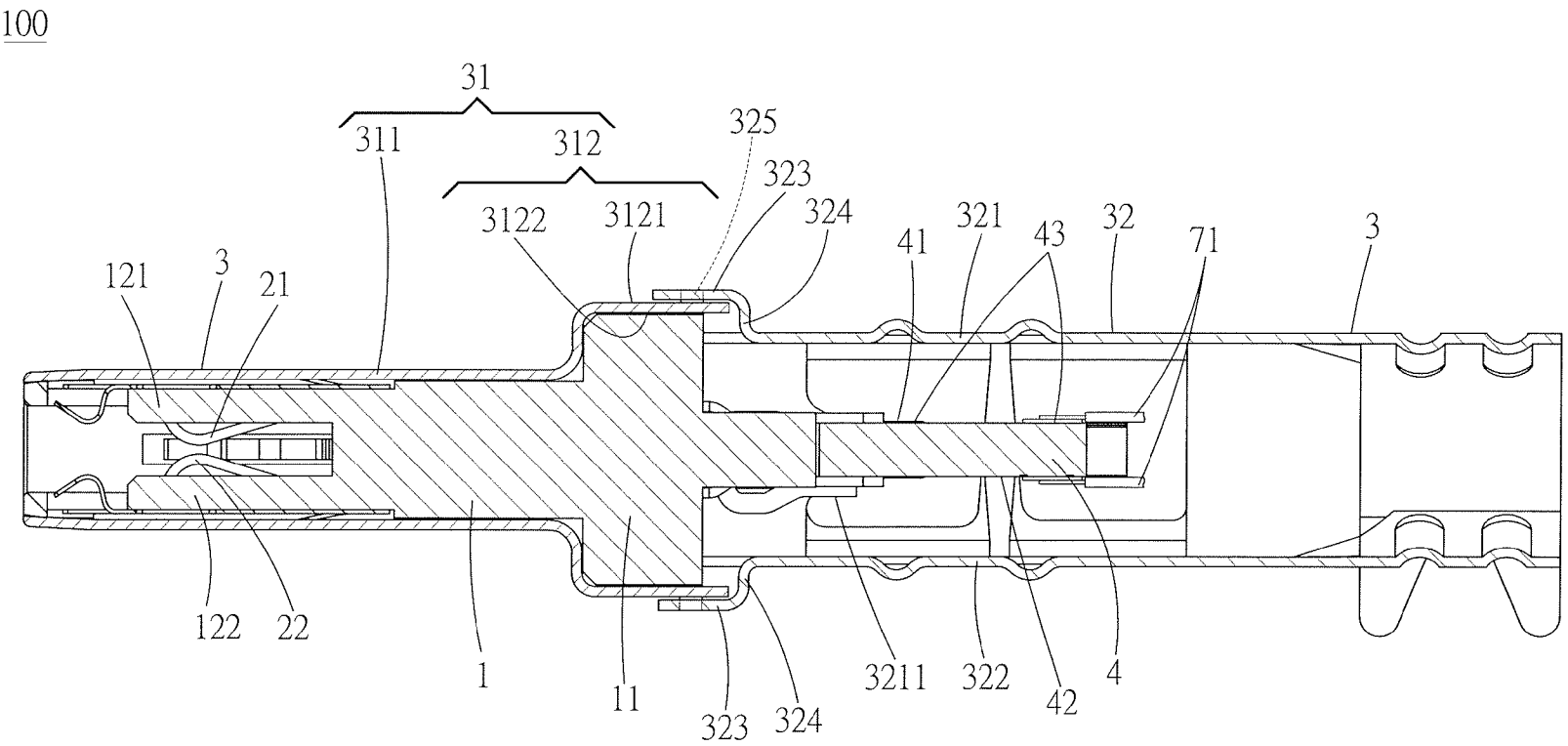
FIG. 9 is a lateral view showing the front shell assembled with the rear shell of the electrical plug connector according to the instant disclosure.

FIG. 9 is a lateral view showing a front shell 31 and a rear shell 32 of the electrical plug connector 100 assembled with each other according to the instant disclosure. Referring to FIG. 1 and FIG. 9, the insulated housing 1 comprises a base member 11 and defines a mating room 13 between an upper portion 121 and a lower portion 122. The upper portion 121 and the lower portion 122 are extending from one side of the base member 11. In this embodiment, the base member 11, the upper portion 121 and the lower portion 122 are formed an unitary member by injection molding techniques for production of the insulated housing 1. The base member 11 also could be formed another unitary member by injection molding techniques and assembled with the upper portion 121 and the lower portion 122 for production of the insulated housing 1. Moreover, the upper portion 121 has an upper mating face 1211, the lower portion 122 has a lower mating face 1221, and the upper mating face 1211 of the upper portion 121 is opposite to the lower mating face 1221 of the lower portion 122.

Figure 1A:
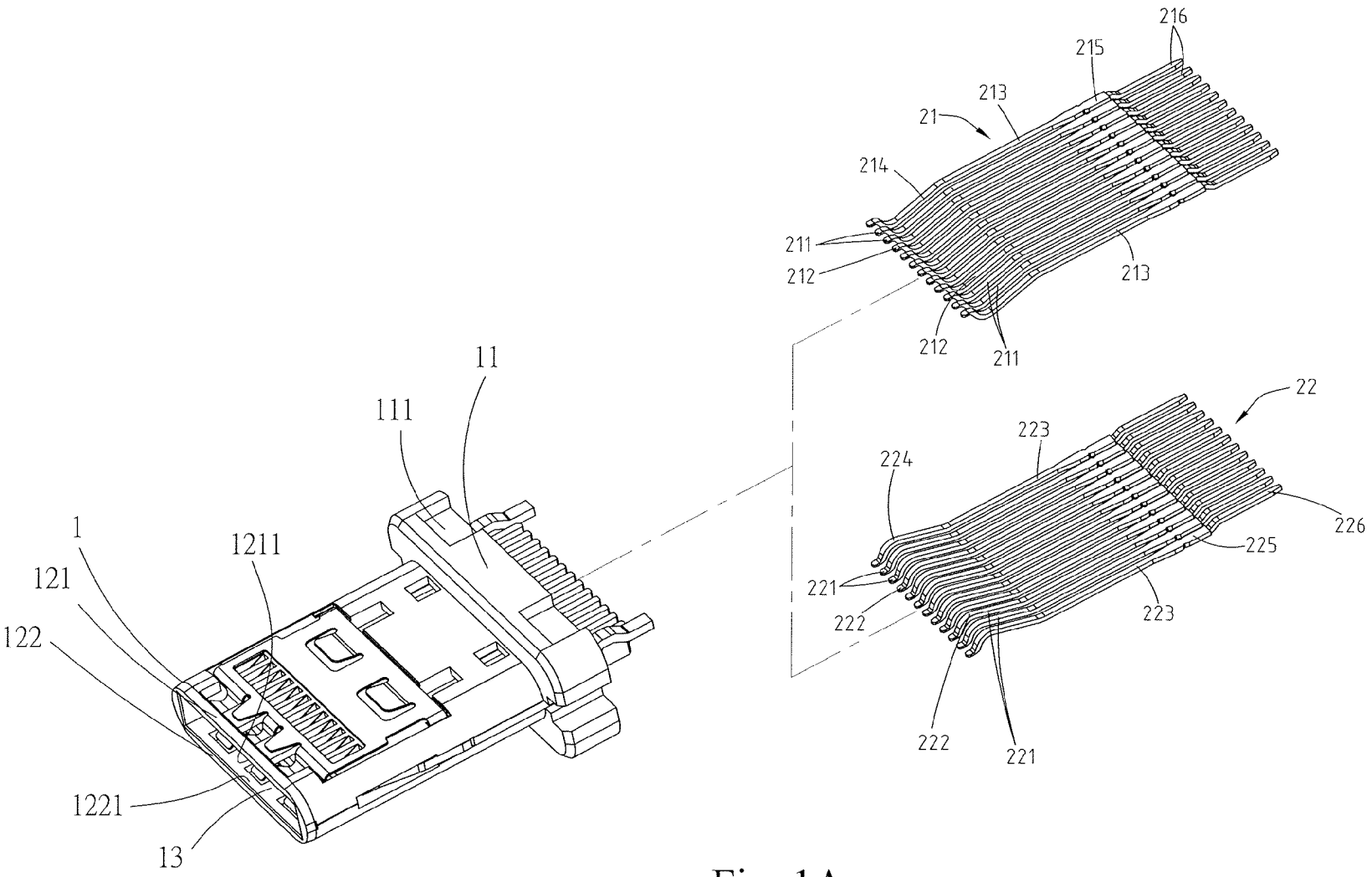
FIG. 1A is an exploded perspective view showing an insulated housing, upper-row plug terminals and lower-row plug terminals of the electrical plug connector according to the instant disclosure.

Please refer to FIG. 1 and FIG. 1A. FIG. 1A is an exploded perspective view showing the insulated housing 1 and the plug terminals 2 of the electrical plug connector 100 according to the instant disclosure. The plug terminals 2 comprise a plurality of upper-row plug terminals 21 and a plurality of lower-row plug terminals 22. The upper-row plug terminals 21 are held in the upper portion 121 and the lower-row plug terminals 22 are held in the lower portion 122. The upper-row plug terminals 21 and the lower-row plug terminals 22 are projected into the mating room 13.

Figure 1B:
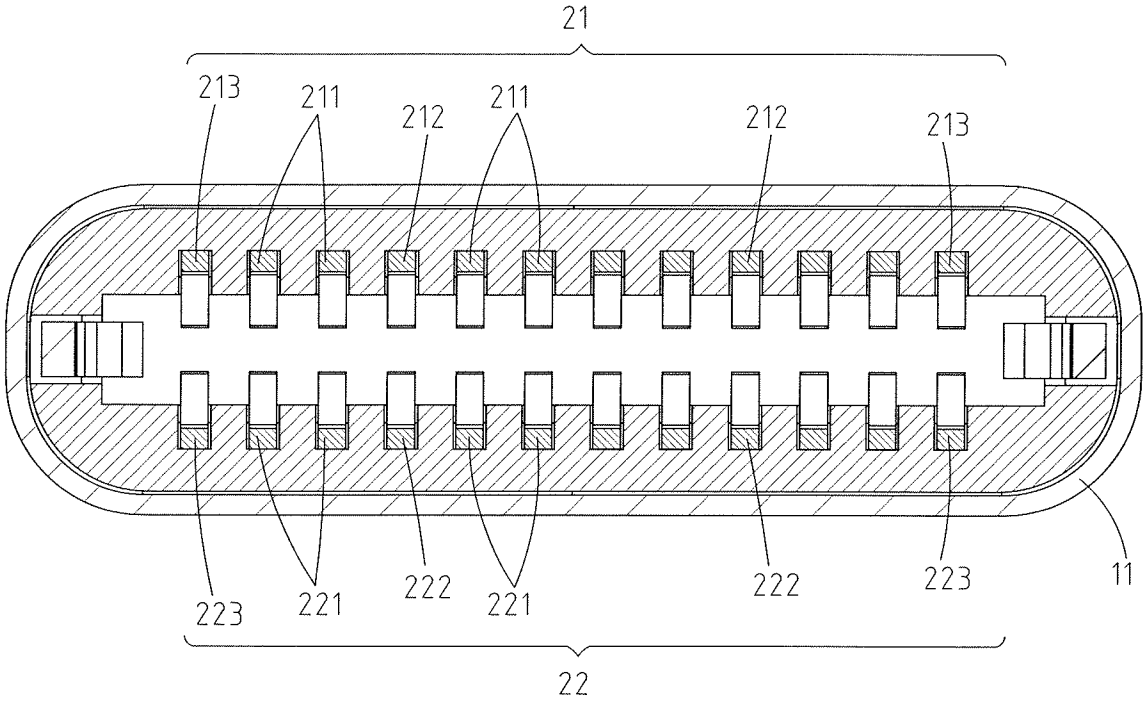
FIG. 1B is a sectional view of the electrical plug connector according to the instant disclosure.

Please refer to FIG. 1A, FIG. 1B and FIG. 1C. FIG. 1B is a sectional view of the electrical plug connector 100 according to the instant disclosure. FIG. 1C is a schematic configuration diagram of the plug terminals 2 of the electrical plug connector 100 shown in FIG. 1B. The upper-row plug terminals 21 are held in the upper portion 121. The upper-row plug terminals 21 comprise a plurality of signal terminals 211, at least one power terminal 212, and at least one ground terminal 213. Each of the upper-row plug terminals 21 is held in the upper portion 121 of the insulated housing 1 and disposed at the upper mating face 1211 of the upper portion 121. Refer to FIG. 1C, the upper-row plug terminals 21 comprise, from right to left, a ground terminal 213 (Gnd), a first pair of differential signal terminals (TX1+−), a second pair of differential signal terminals (D+−), and a third pair of differential signal terminals (RX2+−) of the signal terminals 111, power terminals 212 (Power/VBUS) between the three pairs of differential signal terminals, a retain terminal (RFU), (the retain terminal and a configuration channel 1 (CC1) are respectively arranged between the power terminals 212 and the second pair of differential signal terminals of the signal terminals 211), and another ground terminal 213 (Gnd).

Please refer to FIG. 1A, FIG. 1B and FIG. 1C; in which each of the upper-row plug terminals 21 comprises a body portion 215 held in the insulated housing 1, a flexible contact portion 214 extended from one end of the body portion 215 and disposed at the upper mating face 1211 of the upper portion 121, and a tail portion 216 extended from the other end of the body portion 215 and exposed out of the insulated housing 1. The flexible contact portions 214 of the signal terminals 211 are extending toward the mating room 13 and transmitting first signals (that is, USB 3.0 signals). The tail portions 216 are extended from a rear portion of the insulated housing 1. Furthermore, the tail portions 216 are bent horizontally to form flat legs, named SMT legs, that can be mounted or soldered on the surface of a printed circuit board (PCB) by using surface mount technology, as shown in FIG. 1A.

Please refer to FIG. 1A, FIG. 1B and FIG. 1C. The lower-row plug terminals 22 are held in the lower portion 122. Here, the lower-row plug terminals 22 comprises a plurality of signal terminals 221, at least one power terminal 222, and at least one ground terminal 223. Each of the lower-row plug terminals 22 is held in the lower portion 122 of the insulated housing 1 and disposed at the lower mating face 1221 of the lower portion 122. Refer to FIG. 1C, the lower-row plug terminals 22 comprise, from left to right, a ground terminal 223 (Gnd), a first pair of differential signal terminals (TX2+−), a second pair of differential signal terminals (D+−), and a third pair of differential signal terminals (RX1+−) of the signal terminals 221, power terminals 222 (Power/VBUS) between the three pairs of differential signal terminals, a retain terminal (RFU), (the retain terminal and a configuration channel 2 (CC2) are respectively arranged between the power terminals 222 and the second pair of differential signal terminals of the signal terminals 221), and another ground terminal 223 (Gnd).

Please refer to FIG. 1A, FIG. 1B and FIG. 1C; in which each of the lower-row plug terminals 22 comprises a body portion 225 held in the insulated housing 1, a flexible contact portion 224 extended from one end of the body portion 225 and disposed at the lower mating face 1221 of the lower portion 122, and a tail portion 226 extended from the other end of the body portion 225 and exposed out of the insulated housing 1. The flexible contact portions 224 of the signal terminals 221 are extending toward the mating room 13 and transmitting second signals (that is, USB 3.0 signals). The tail portions 226 are extended from the rear portion of the insulated housing 1. Furthermore, the tail portions 226 are bent horizontally to form flat legs, named SMT legs, that can be mounted or soldered on the surface of a printed circuit board (PCB) by using surface mount technology, as shown in FIG. 1A.

Please refer to FIG. 1A, FIG. 1B and FIG. 1C, in which embodiment the upper-row plug terminals 21 and the lower-row plug terminals 22 are respectively at the upper mating face 1211 of the upper portion 121 and the lower mating face 1221 of the lower portion 122. Furthermore, the upper-row plug terminals 21 and the lower-row plug terminals 22 are point-symmetrical with a central point of the receiving cavity 30 as the symmetrical center. In other words, pin-assignments of the upper-row plug terminals 21 and the lower-row plug terminals 22 have 180 degree symmetrical design with respect to the central point of the receiving cavity 30 as the symmetrical center. The dual or double orientation design enables the electrical plug connector 100 to be inserted into an electrical receptacle connector in either of two intuitive orientations, i.e., in either upside-up or upside-down directions. Here, point-symmetry means, after the upper-row plug terminals 21 (or the lower-row plug terminals 22) are rotated by 180 degrees with the symmetrical center as the rotating center, the upper-row plug terminals 21 and the lower-row plug terminals 22 are overlapped. That is, the rotated upper-row plug terminals 21 are arranged at the position of the original lower-row plug terminals 22, and the rotated lower-row plug terminals 152 are arranged at the position of the original upper-row plug terminals 21. In other words, the upper-row plug terminals 21 and the lower-row plug terminals 22 are arranged upside down, and the pin assignments of the upper-row plug terminals 21 are left-right reversal with respect to the pin assignments of the lower-row plug terminals 22. Accordingly, the electrical plug connector 100 is inserted into an electrical receptacle connector with a first orientation where the upper portion 121 of the insulated housing 1 of the electrical plug connector 100 is facing up, for transmitting first signals; conversely, the electrical plug connector 100 is inserted into the electrical receptacle connector with a second orientation where the upper portion 121 of the insulated housing 1 of the electrical plug connector 100 is facing down, for transmitting second signals. The specification for transmitting the first signals conforms to that for transmitting the second signals. Based on this, the inserting orientation of the electrical plug connector 100 is not limited Please refer to FIG. 1A, FIG. 1B and FIG. 1C again; in which embodiment positions of upper-row plug terminals 21 correspond to positions of the lower-row plug terminals 22.

Figure 2:
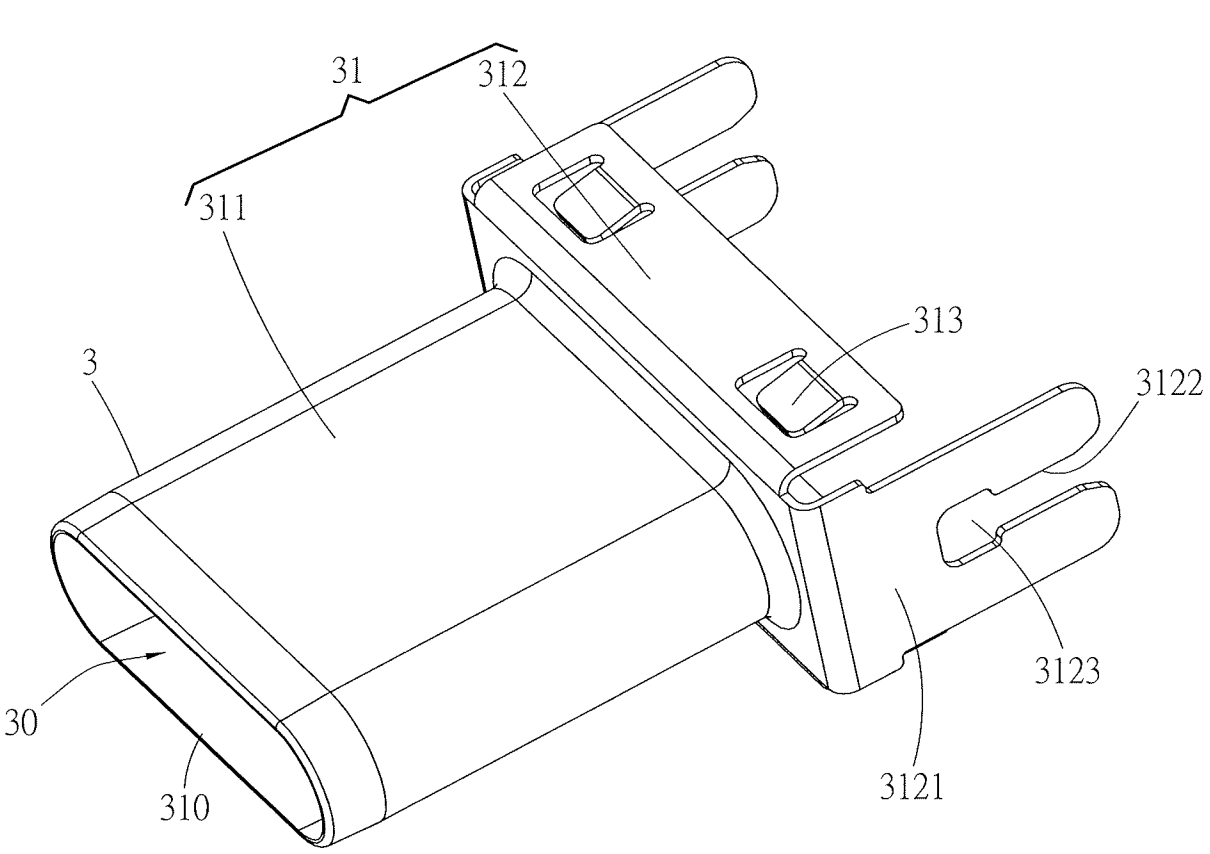
FIG. 2 is a schematic perspective view (1) of a metallic shell of the electrical plug connector according to the instant disclosure.
Figure 3:
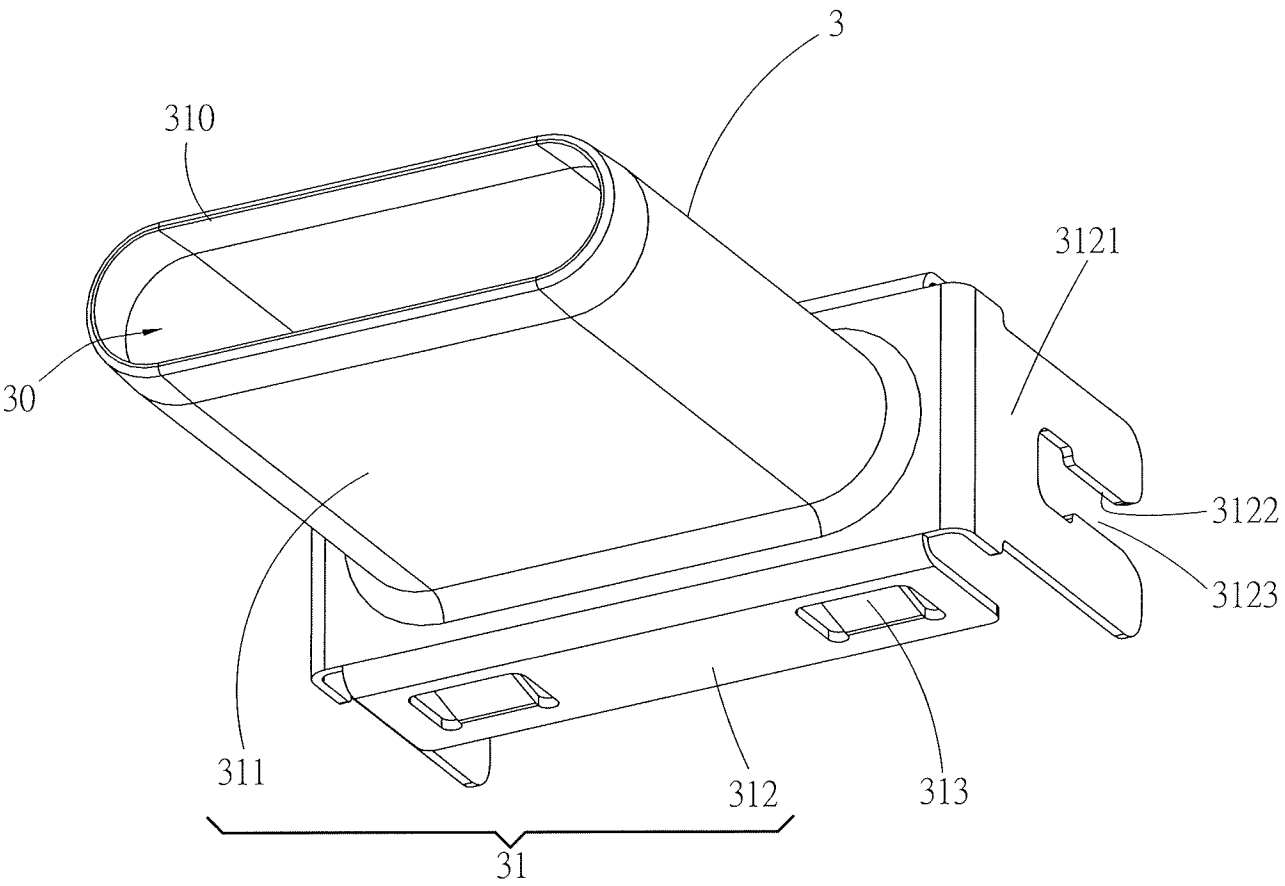
FIG. 3 is a schematic perspective view (2) of the metallic shell of the electrical plug connector according to the instant disclosure.

FIG. 2 is a schematic perspective view (1) of the metallic shell 3 of the electrical plug connector 100 according to the instant disclosure, and FIG. 3 is a schematic perspective view (2) of the metallic shell 3 of the electrical plug connector 100 according to the instant disclosure. Referring to FIG. 1, FIG. 2, and FIG. 3 again, the metallic shell 3 encloses the insulated housing 1, and the metallic shell 3 is a multi-piece member. The metallic shell 3 comprises a front shell 31 and a rear shell 32. The front shell 31 comprises a front case body 311 and a rear case body 312. In this embodiment, the front case body 311 of the metallic shell 3 is a hollowed shell, which may be formed by a deep drawing technique with the use of a pressing die.

Figure 4:
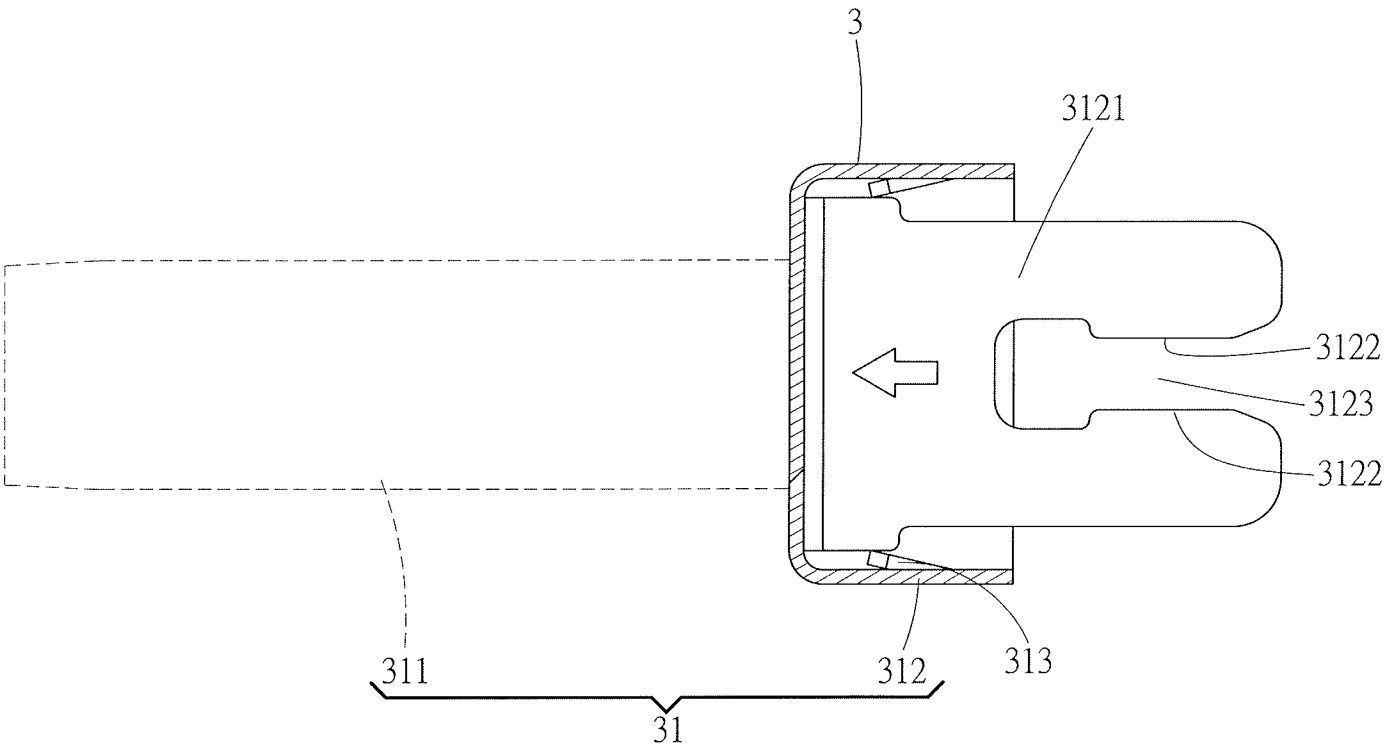
FIG. 4 is a lateral sectional view showing an unprocessed metallic shell of the electrical plug connector according to the instant disclosure.
Figure 5:
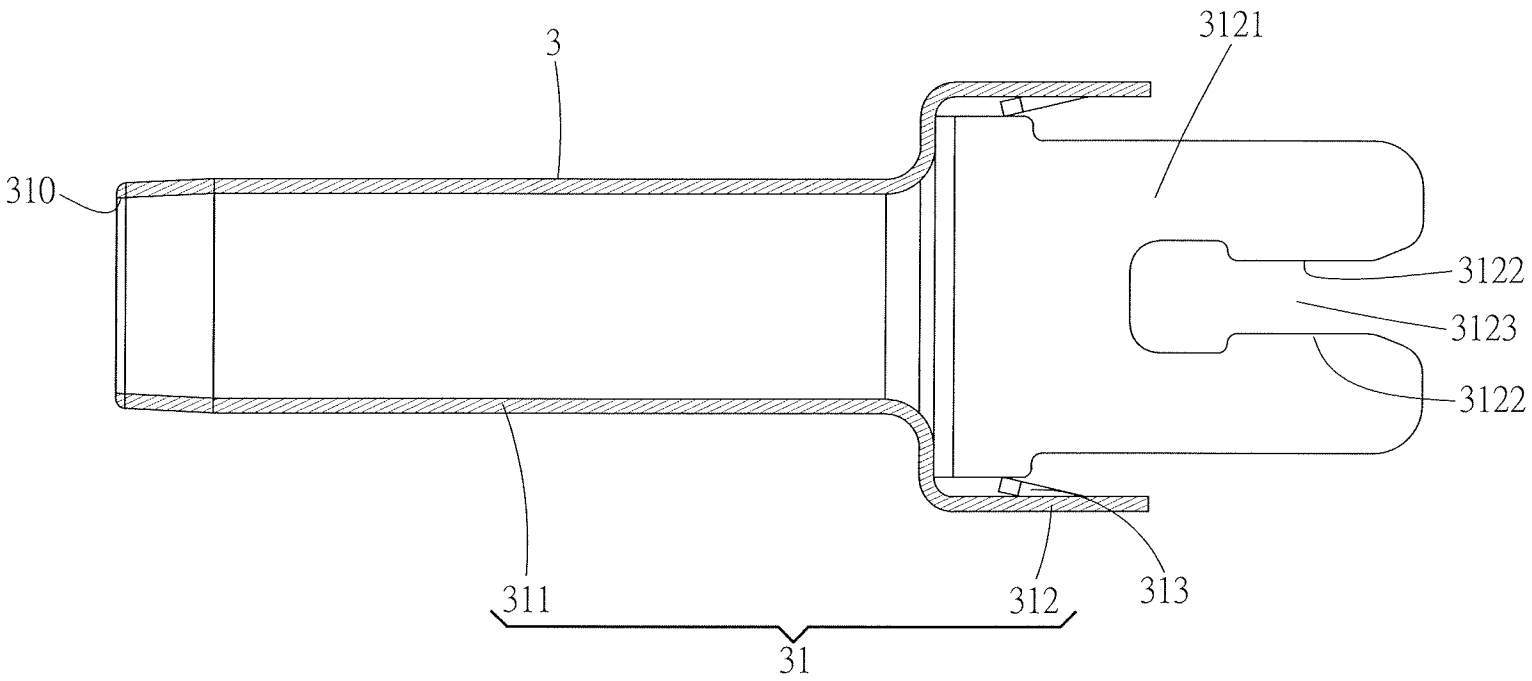
FIG. 5 is a lateral sectional view showing a processed metallic shell of the electrical plug connector according to the instant disclosure.

FIG. 4 is a lateral view of showing an unprocessed metallic shell 3 of the electrical plug connector 100 according to the instant disclosure, and FIG. 5 is a lateral view showing a processed metallic shell 3 of the electrical plug connector 100 according to the instant disclosure. Referring to FIG. 4, FIG. 5 and FIG. 9, the front case body 311 encloses the upper portion 121 and the lower portion 122. That is, the upper portion 121 and the lower portion 122 are received inside a receiving cavity 30 of the front body 311. When a deep drawing technique is applied to the rear case body 312, the front case body 311 is formed at a front end of the rear case body 312, and the front case body 311 is formed as a seamless hollow shell (as shown in FIG. 2 and FIG. 3). That is, the structure of the front case body 311 is devoid of cracks, and the appearance of the front body 311 is seamless to improve the beauty of the metallic shell 3. In addition, the front case body 311 is formed as a seamless hollow shell, allowing the structure of the front case body 311 to be devoid of any cracks, so that the problem of undesirable shielding effect caused by cracks can be avoided, problems of electromagnetic interference (EMI) and radiofrequency interference (RFI) are reduced, and the problem of poor shielding is further improved. Moreover, since the front case body 311 is a seamless hollow shell, the structural strength can be increased and a misalignment problem of the metallic shell 3 may be effectively prevented when the electrical plug connector 100 is being plugged in an electrical receptacle connector.

Referring to FIG. 4, FIG. 5, and FIG. 9, the rear case body 312 is at the rear side of the front case body 311 and encloses the base member 11. That is, the base member 11 is received inside the rear body 312. Furthermore, the front case body 311 is protruded from the front end of the rear case body 312 to enclose the upper portion 121 and the lower portion 122. In this embodiment, the front case body 311 and the rear case body 312 are formed by the same piece. In addition, the rear shell 32 encloses a rear side of the base member 11; the rear shell 32 comprises a front extending plate 323 which is approximately located at a central position of a front side of the rear shell 32. In this embodiment, the front extending plate 323 is lapped on the rear case body 312 to fasten the rear case body 312 with the rear shell 32. Moreover, the width of the front extending plate 323 is smaller than the width of the rear case body 312, but the instant disclosure is not limited thereto. In some implementation aspects, the width of the front extending plate 323 can also be approximately equal to the width of the rear case body 312; that is, the width of the front extending plate 323 may approximately equal to the width of the rear case body 312, so that the front extending plate 323 encloses the rear case body 312 entirely. Furthermore, after the rear shell 32 and the rear case body 312 are fastened with each other by the front extending plate 323, the rear shell 32 and the rear case body 312 may be assembled with each other by a large-area overlapping, which may provide a firmly fixture.

Referring to FIG. 4 and FIG. 5 again, upon processing the metallic shell 3, at the beginning, the rear case body 312 is a one piece plate structure (as shown in FIG. 4). Next, the rear case body 312 is processed by using a pressing die, and the front case body 311 is formed on the rear case body 312 by applying a deep drawing technique to the rear case body 312 with using the pressing die. That is, the pressing die can press the rear case body 312 repeatedly, so that the front case body 311 is protruded and formed at the front portion of the rear case body 312. Specifically, in this embodiment, the pressing die includes a concave base body and a punch, and the rear case body 312 is placed between the concave base body and the punch. After the center of the rear case body 312 is pressed repeatedly by the punch, the front case body 311 is protruded from the rear case body 312. Here, the front case body 311 is formed in the concave base body and is formed as a hollow cylinder (a tubular structure). Subsequently, a process of blanking and punching is then applied to a front end of the front case body 311, so that an opening 310 (as shown in FIG. 5) is then formed at the front side of the front case body 311.

Referring to FIG. 5 and FIG. 9 again, when a front shell 31 encloses the insulated housing 1, the rear body 312 encloses the base member 11. Next, the rear shell 32 is assembled with the front shell 31 from a rear side of the insulated housing 1, so that the front extending plate 323 of the rear shell 32 is lapped on the rear case body 312. Accordingly, the front extending plate 323 and the rear case body 312 are fastened together.

Figure 8:
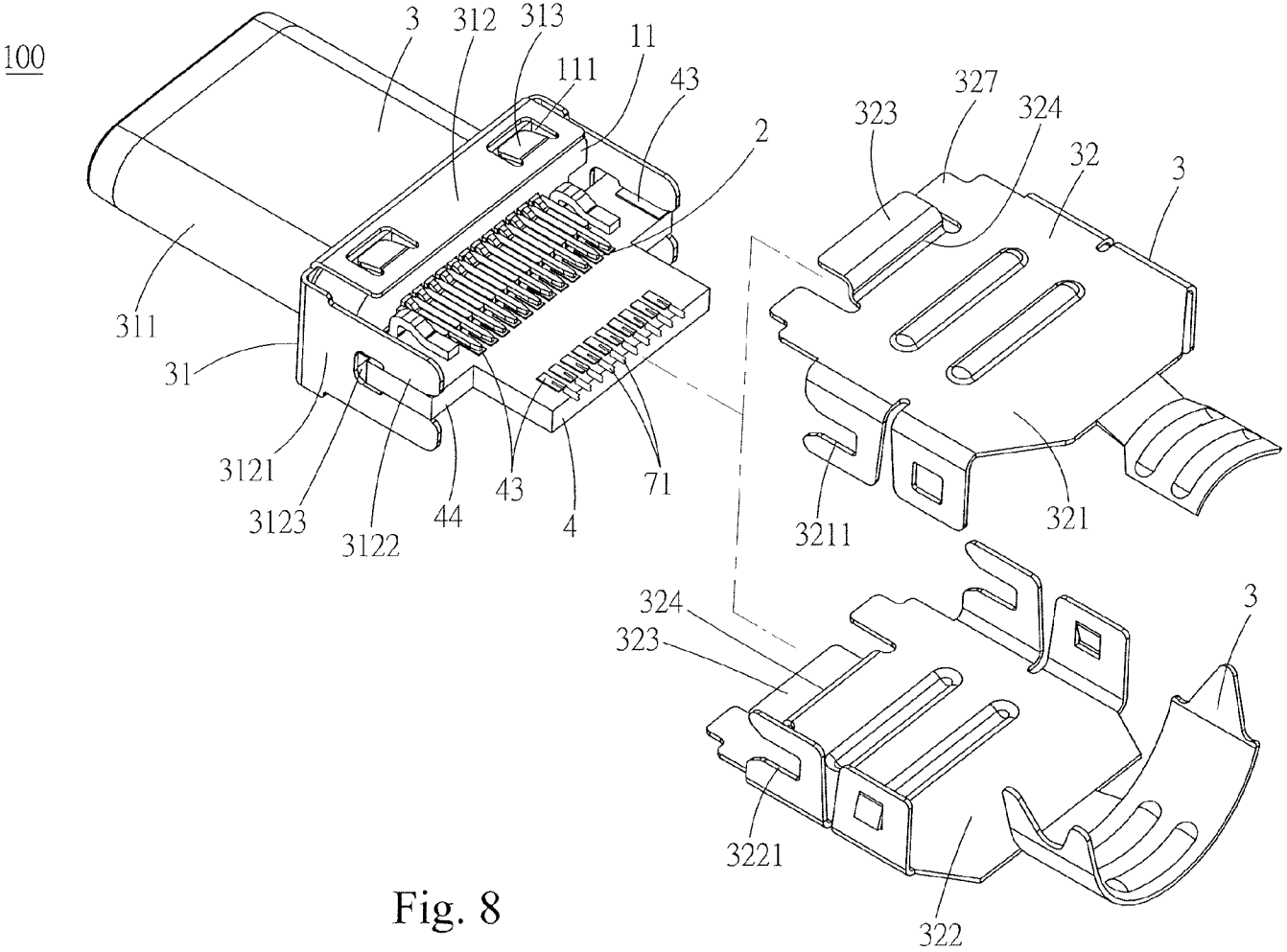
FIG. 8 is an exploded perspective view showing a front shell assembled with a rear shell of the electrical plug connector according to the instant disclosure.
Figure 10:
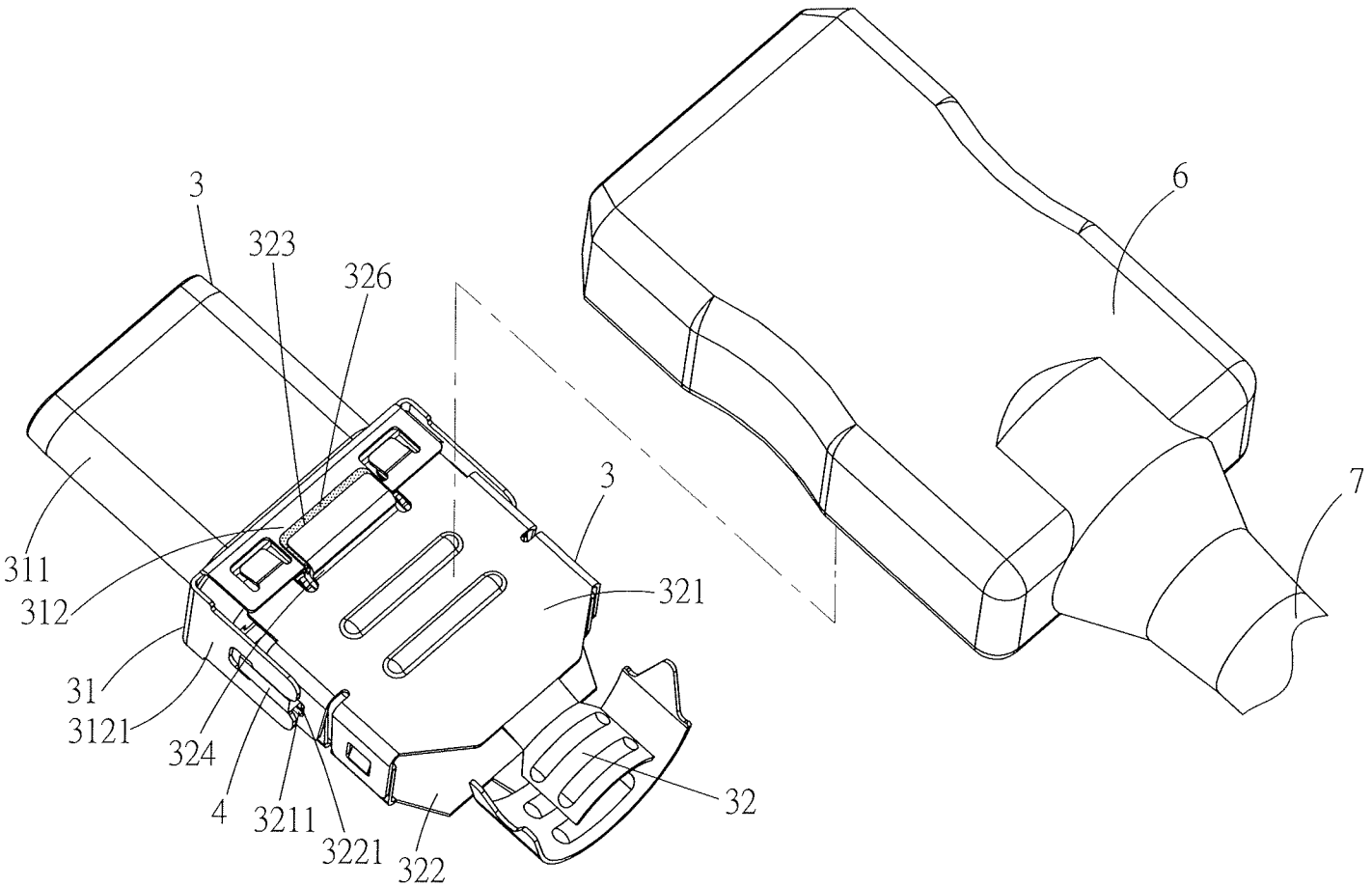
FIG. 10 is an exploded perspective view showing an enveloping shell overmolded on the metallic shell of the electrical plug connector according to the instant disclosure.

FIG. 8 is an exploded perspective view showing the front shell 31 assembled with the rear shell 32 of the electrical plug connector 100 according to the instant disclosure, FIG. 9 is a lateral view showing the front shell 31 assembled with the rear shell 32 of the electrical plug connector 100 according to the instant disclosure, and FIG. 10 is an exploded perspective view showing an enveloping shell 6 overmolded on the metallic shell 3 of the electrical plug connector 100 according to the instant disclosure. Please refer to FIG. 8, FIG. 9 and FIG. 10, several implementations for the fastening between the front shell 31 and the rear shell 32 are provided. In one implementation aspect, the rear shell 32 comprises a plurality of connecting points 325 at the front extending plate 323 and connected to the rear case body 312; that is, the front extending plate 323 and the rear case body 312 are connected by a laser beam welding process (as shown in FIG. 9). The laser beam welding process may be performed to a surface of the front extending plate 323 so as to form the connecting points 325 on the front extending plate 323. Furthermore, the connecting points 325 are connected to the rear case body 312, so that the front extending plate 323 and the rear case body 312 are integrated and tightly fastened with each other. In another implementation, the rear shell 32 comprises a plurality of connecting segments 326 at a periphery of the front extending plate 323 and connected to the rear case body 312 (as shown in FIG. 10); that is, the front extending plate 323 and the rear case body 312 may be connected with each other by applying a tin-soldering process. In detail, the tin-soldering process is applied to the periphery of the front extending plate 323 to allow the front extending plate 323 to connect with a surface of the rear case body 312, so that the front extending plate 323 and the rear case body 312 are integrated and tightly fastened with each other. In further another implementation aspect, the front extending plate 323 comprises an abutting piece (not shown), and the abutting piece abuts against the rear case body 312, enabling the front extending plate 323 and the rear case body 312 to be tightly assembled with each other. In yet another implementation aspect, the rear case body 312 comprises an abutting piece (not shown), and the abutting piece abuts against the front-end extending plate 323, enabling the front extending plate 323 and the rear case body 312 to be tightly combined with each other. In embodiments of the instant disclosure, the front extending plate 323 is lapped on the rear case body 312 so as to keep consistency and continuity for signal transmission between the front shell 31 and the rear shell 32. In addition, because the front extending plate 323 and the rear case body 312 are lapped and fastened together, gaps are not formed between the front extending plate 323 and the rear case body 312, and the metallic shell 3 performs a desirable shielding effect, thus the problem of RFI caused by poor shielding of the metallic shell 3 can be effectively prevented.

Please refer to FIG. 1, FIG. 8, FIG. 9 and FIG. 10; in which embodiment the insulated housing 1 further comprises a circuit board 4 and an enveloping shell 6. The circuit board 4 is at the rear side of the base member 11, and the circuit board 4 is enclosed by the enveloping shell 6 and a transmission wire 7. Furthermore, the metallic shell 3 encloses the circuit board 4 to protect the circuit board 4. After a wire material 71 of the transmission wire 7 is soldered on the circuit board 4, overmolding is applied over the circuit board 4 to prevent electronic components soldered on the circuit board 4 from being damaged. For example, during applying glue to the interior of the metallic shell 3, the metallic shell 3 protects electronic components on the circuit board 4 from being damaged. Here, the rear shell 32 comprises an upper shell 321 and a lower shell 322 secured with each other, and the upper shell 321 and the lower shell 322 are above and below the circuit board 4, respectively. The upper shell 321 further comprises a plurality of first abutting sidewalls 3211 clamped at two sides of the circuit board 4. The lower shell 322 further comprises a plurality of second abutting sidewalls 3221, and the second abutting sidewalls 3221 are approximately partially overlapped with the first abutting sidewalls 3211 and clamped at the two sides of the circuit board 4.

In addition, referring to FIG. 1, FIG. 8, and FIG. 9 again; in which embodiment the circuit board 4 further comprises an upper surface 41, a lower surface 42, and a plurality of contacts 43. The contacts 43 are at two sides of the upper surface 41 and two sides of the lower surface 42. When the upper shell 321 and the lower shell 322 of the rear shell 32 are combined on the circuit board 4, the first abutting sidewalls 3211 and the second abutting sidewalls 3221 are connected to the contacts 43, so that the rear shell 32 is electrically connected to the circuit board 4 to effectively conduct and ground noises, thereby mitigating the EMI problem.

Figure 6:
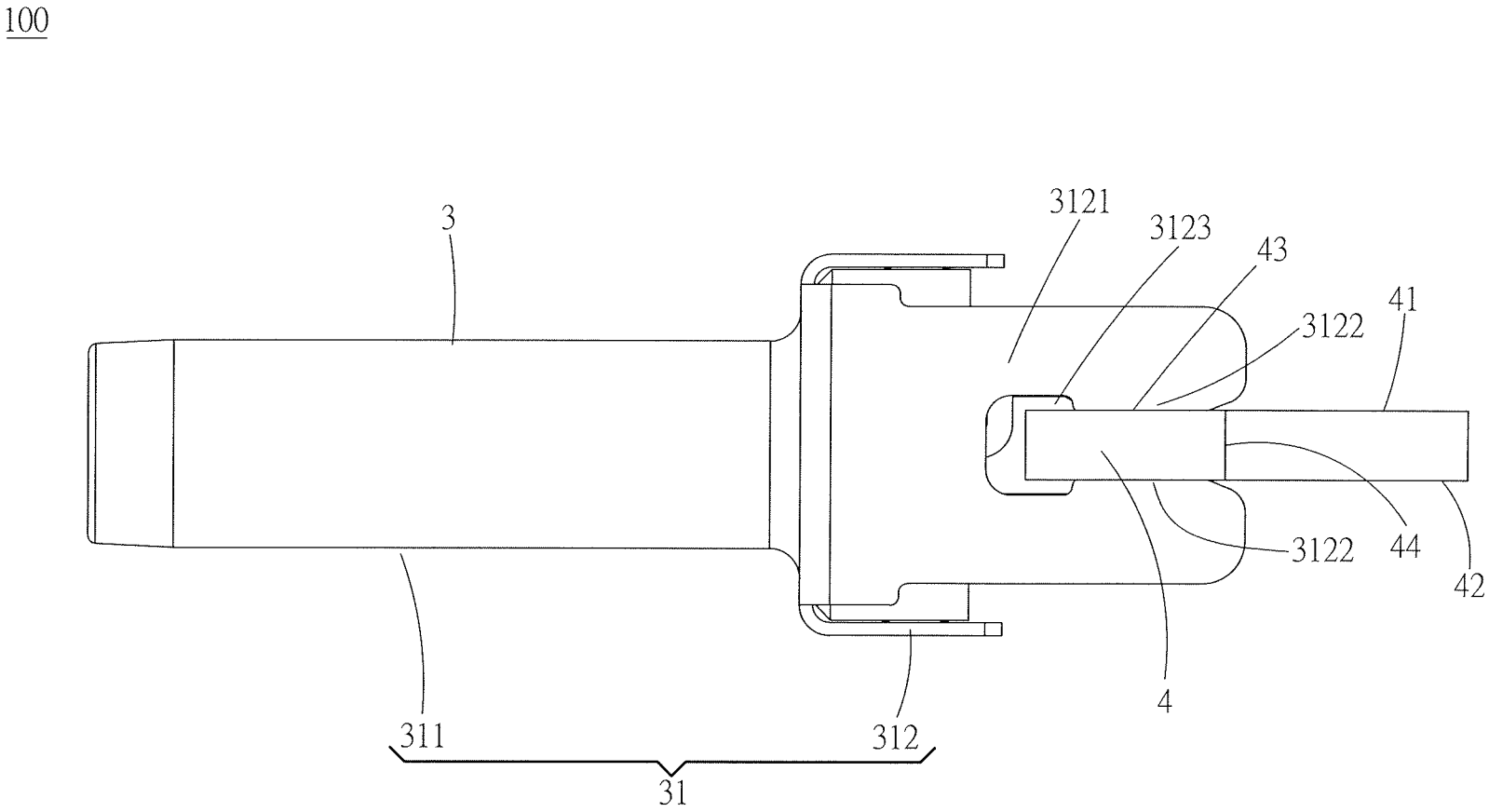
FIG. 6 is a schematic side view of the metallic shell and a circuit board of the electrical plug connector according to one embodiment of the instant disclosure.
Figure 7:
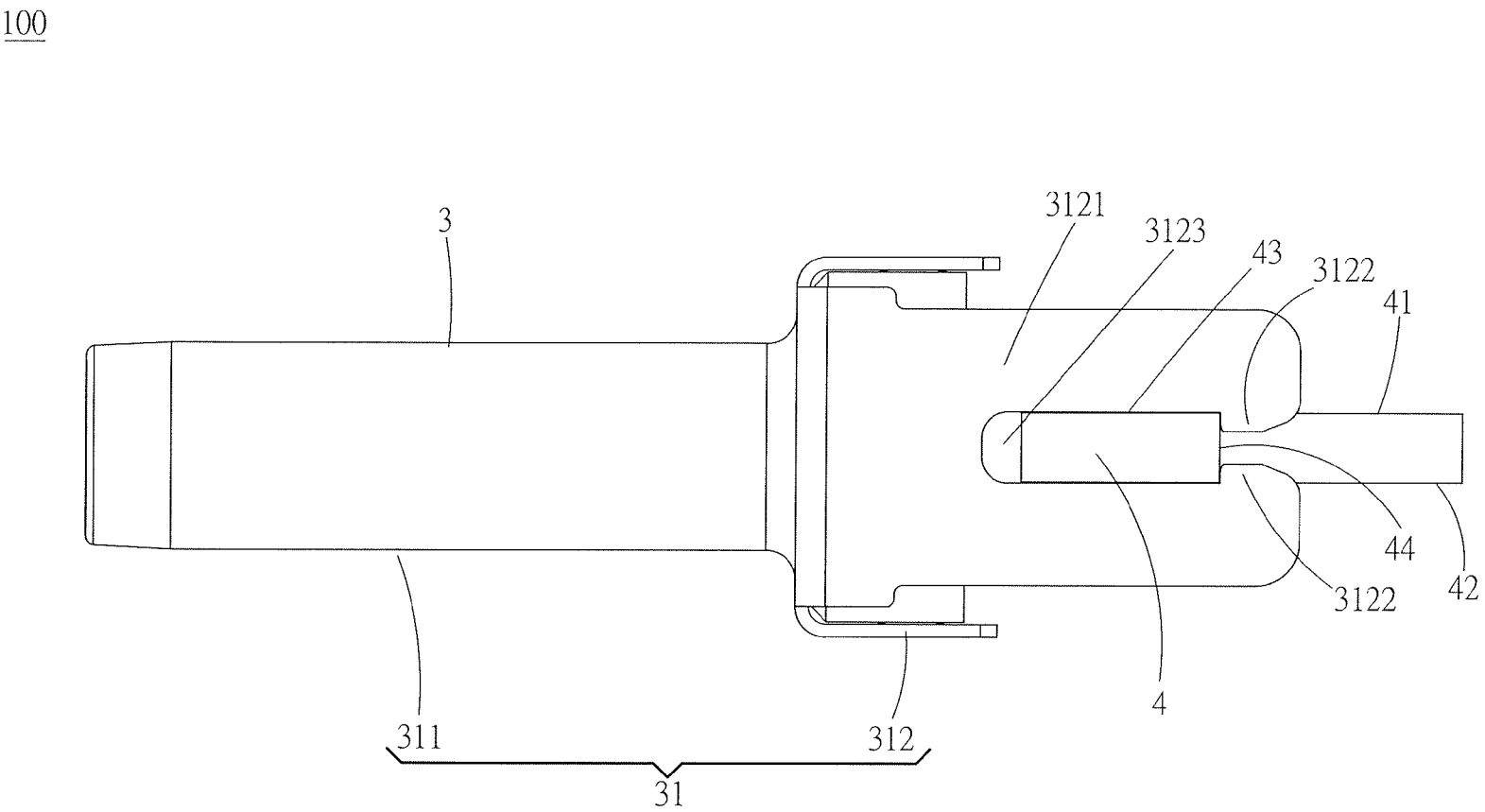
FIG. 7 is a schematic side view of the metallic shell and the circuit board according to another embodiment of the instant disclosure.

FIG. 6 is a schematic side view of the metallic shell 3 and the circuit board 4 according to the instant disclosure, and FIG. 7 is a schematic side view of the metallic shell 3 and the circuit board 4 according to the instant disclosure, for another embodiment. Referring to FIG. 6, FIG. 7, and FIG. 8; the metallic shell 3 further comprises two clamping sidewalls 3121 respectively at two sides of the rear case body 312 and extending backward in parallel. The clamping sidewalls 3121 are clamped at the two sides of the circuit board 4. The clamping sidewalls 3121 can be electrically connected to the contacts 43 on the upper surface 41 and the lower surface 42 of the circuit board 4, for effective conducting and grounded the noises to solve the EMI and RFI problems. Furthermore, each of the clamping sidewalls 3121 further comprises a plurality of hook portions 3122 and a clamping space 3123, and each of the clamping space 3123 is defined between the corresponding hook portions 3122. The two sides of the circuit board 4 are received in the clamping space 3123 for limiting movement. That is, the clamping spaces 3123 are respectively defined between corresponding hook portions 3122 to receive the two sides of the circuit board 4. In this embodiment, the hook portions 3122 are symmetrical to each other. That is, each of the clamping sidewalls 3121 has an upper hook portion 3122 and a lower hook portion 3122 opposite to the upper hook portion 3122, and the upper hook portion 3122 and the lower hook portion 3122 are abutted against the upper surface 41 and the lower surface 42 of the circuit board 4, respectively (as shown in FIG. 6), but the instant disclosure is not limited thereto. In some implementation aspects, the upper hook portion 3122 and the lower hook portion 3122 can be abutted against a rear surface 44 of the circuit board 4 (as shown in FIG. 7).

Referring back to FIG. 9; in some embodiments the front extending plate 323 can be lapped on a top surface or a rear surface of the rear case body 312. That is, as shown in FIG. 9, plural of front extending plates 323 are, respectively, lapped on the top surface and the rear surface of the rear case body 312, but the instant disclosure is not limited thereto. Furthermore, the front extending plate 323 may be stacked on the rear case body 312, and through subsequent processing, the front extending plate 323 and the rear case body 312 are fastened with each other.

Referring back to FIG. 8 and FIG. 9; in some embodiments, the rear shell 32 further comprises a bending segment 324 connected to the front extending plate 323. Base on this, the position of the front extending plate 323 on the rear shell 32 is changed by using the bending segment 324, so that the horizontal position of the front extending plate 323 can be changed to enable the front extending plate 323 to be lapped on the rear case body 312. Furthermore, during the formation of the bending segment 324 on the rear shell 32, cracks are formed at two sides of the front extending plate 323 so as to facilitate the process for forming the bending segment 324 on the front extending plate 323.

Referring back to FIG. 1 and FIG. 8; in some embodiments, the base member 11 further comprises a plurality of recessed portions 111 at two sides of an upper surface and two sides of a lower surface of the base member 11. The rear shell 32 further comprises a plurality of positioning plates 327. The positioning plates 327 are at the two sides of the front extending plate 323 and are secured with the recessed portions 111, respectively, so that the rear shell 32 and the base member 11 are fastened with each other. That is, the positioning plates 327 are respectively fastened with the recessed portions 111 to prevent the lateral movements of the rear shell 32. In addition, the front shell 31 further comprises a plurality of abutting plates 313 deflectedly extending toward the recessed portions 111, respectively; moreover, the abutting plates 313 are at the rear case body 312 to extend to and abut against inner side surfaces of the recessed portions 111, respectively. Based on this, the abutting plates 313 are positioned above the positioning plates 327 to prevent the positioning plates 327 from detaching off the recessed portions 111.

In the instant disclosure, a front case body is formed, by deep drawing techniques, at a front side of a rear case body, and the front case body is formed as a seamless hollow shell. The front case body can be molded and manufactured through blanking and bending. The structure of the front case body does not have any crack, so there the appearance of the front case body is seamless to improve the beauty of the metallic shell. In addition, the front case body is formed as a seamless hollow shell, making that the structure of the front case body be devoid of cracks, so that a problem of an undesirable shielding effect caused by cracks can be avoided, problems of EMI and RFI are reduced, and the problem of poor shielding performance is further mitigated. Moreover, since the front case body is a seamless hollow shell, the structural strength can be increased, and a misalignment problem of the metallic shell may be effectively prevented when the electrical plug connector is being plugged in an electrical receptacle connector. In addition, two clamping sidewalls at two sides of the rear case body is electrically connected to a circuit board for effective transmitting and grounded, so as to mitigate the problems of EMI and RFI. Furthermore, pin-assignments of the upper-row plug terminals and the lower-row plug terminals are 180 degree symmetrical, dual or double orientation design which enable the electrical plug connector to be inserted into an electrical receptacle connector in either of two intuitive orientations, i.e. In either upside-up or upside-down directions. In other words, the pin-assignments of the upper-row plug terminals and the lower-row plug terminals have 180 degree symmetrical, dual or double orientation design with respect to a central point of the receiving cavity as the symmetrical center. Consequently, the electrical plug connector is inserted into an electrical receptacle connector with a first orientation where the upper portion is facing up, for transmitting first signals; conversely, the electrical plug connector is inserted into the electrical receptacle connector with a second orientation where the upper portion is facing down, for transmitting second signals. Furthermore, the specification for transmitting the first signals is conformed to the specification for transmitting the second signals. Consequently, the inserting orientation of the electrical plug connector is not limited.

While the disclosure has been described by the way of example and in terms of the preferred embodiments, it is to be understood that the invention need not be limited to the disclosed embodiments. On the contrary, it is intended to cover various modifications and similar arrangements included within the spirit and scope of the appended claims, the scope of which should be accorded the broadest interpretation so as to encompass all such modifications and similar structures.

What is claimed is:

1. An electrical plug connector, comprising:

an insulated housing comprising a base member, an upper portion, and a lower portion, wherein a mating room is defined between the upper portion and the lower portion, the upper portion has an upper mating face, the lower portion has a lower mating face, and the upper mating face is opposite to the lower mating face;

a plurality of upper-row plug terminals held in the upper portion, wherein the upper-row plug terminals comprise a plurality of signal terminals, at least one power terminal, and at least one ground terminal, each of the upper-row plug terminals is held in the upper portion of the insulated housing and disposed at the upper mating face of the upper member;

a plurality of lower-row plug terminals held in the lower portion, wherein the lower-row plug terminals comprises a plurality of signal terminals, at least one power terminal and at least one ground terminal, each of the lower-row plug terminals is held in the lower portion of the insulated housing and disposed at the lower mating face of the lower portion; and a metallic shell, wherein the insulation housing received inside the metallic shell, comprising:

a rear case body, wherein the rear case body encloses the base member, and the base member is received inside the rear case body;

a front case body formed as a seamless hollow shell at a front side of the rear case body, wherein the front case body protrudes from the front side of the rear case body, and the front case body defines a receiving cavity therein to dispose the upper portion and the lower portion; and two clamping sidewalls at two sides of the rear case body and clamped at two sides of a circuit board.

2. The USB electrical receptacle connector according to claim 1, wherein the width of the second body is greater than the width of the second contact portion.

3. The electrical plug connector according to claim 1, wherein the circuit board is assembled with a rear side of the base member of the insulated housing.

4. The electrical plug connector according to claim 1, wherein the circuit board comprises an upper surface, a lower surface, and a plurality of contacts, and the contacts are respectively at two sides of the upper surface and two sides of the lower surface of the circuit board and are electrically connected to the clamping sidewalls.

5. The electrical plug connector according to claim 1, wherein each of the clamping sidewalls comprises an upper hook portion, a lower hook portion, wherein a clamping space defined between the upper hook portion and the lower hook portion, the upper hook portion is opposite to the lower hook portion, the upper hook portion is abutted against the upper surface of the circuit board and the lower hook portion is abutted against the lower surface of the circuit board.

6. The electrical plug connector according to claim 5, wherein the upper hook portions and the lower hook portion are symmetrical to each other to abut against the upper surface and the lower surface of the circuit board.

7. The electrical plug connector according to claim 5, wherein the upper hook portions and the lower hook portion are abutted against a rear surface of the circuit board.

8. The electrical plug connector according to claim 1, wherein the base member comprises a plurality of recessed portions, and the rear case body comprises a plurality of abutting plates, wherein the recessed portions are respectively abutted against the abutting plates.

9. The electrical plug connector according to claim 1, wherein the metallic shell further comprises a rear shell enclosing a rear side of the base member, and the rear shell comprises a front extending plate lapped on the rear case body to fasten the rear case body with the rear shell.

10. The electrical plug connector according to claim 1, wherein each of the upper-row plug terminals comprises:

a body portion held in the insulated housing;

a flexible contact portion, extended from one of two ends of the body portion and disposed at the upper mating face of the upper portion; and a tail portion extended from the other end of the body portion and exposed out of the insulated housing.

11. The electrical plug connector according to claim 1, wherein each of the lower-row plug terminals comprises:

a body portion held in the insulated housing;

a flexible contact portion extended from one of two ends of the body portion and disposed at the lower mating face of the lower portion; and a tail portion extended from the other end of the body portion and exposed out of the insulated housing.

12. The electrical plug connector according to claim 1, wherein the upper-row plug terminals and the lower-row plug terminals have 180 degree symmetrical design with respect to a central point of the receiving cavity as the symmetrical center.

13. The electrical plug connector according to claim 1, wherein the upper portion and the lower portion are extended from one side of the base member.

14. The electrical plug connector according to claim 1, wherein the base member, the upper portion and the lower portion are formed an unitary member by injection molding techniques for production of the insulated housing.

15. The electrical plug connector according to claim 1, wherein the base member is formed an unitary member by injection molding techniques and assembled with the upper portion and the lower portion for production of the insulated housing.

16. An electrical plug connector, comprising:

an insulated housing comprising a base member, an upper portion, and a lower portion, wherein a mating room is defined between the upper portion and the lower portion, the upper portion has an upper mating face, the lower portion has a lower mating face, and the upper mating face is opposite to the lower mating face;

a plurality of upper-row plug terminals held in the upper portion, wherein the upper-row plug terminals comprise a plurality of signal terminals, at least one power terminal, and at least one ground terminal, each of the upper-row plug terminals is held in the upper portion of the insulated housing and disposed at the upper mating face of the upper member;

a plurality of lower-row plug terminals held in the lower portion, wherein the lower-row plug terminals comprises a plurality of signal terminals, at least one power terminal and at least one ground terminal, each of the lower-row plug terminals is held in the lower portion of the insulated housing and disposed at the lower mating face of the lower portion; and a metallic shell, wherein the insulation housing received inside the metallic shell, comprising:

a rear case body, wherein the rear case body encloses the base member and the base member is received inside the rear case body; and a front case body formed at a front side of the rear case body, wherein the front case body protrudes from the front side of the rear case body, and the front case body defines a receiving cavity therein to dispose the upper portion and the lower portion; and two clamping sidewall at two sides of the rear case body and clamped at two sides of a circuit board.

17. The electrical plug connector according to claim 16, wherein the circuit board comprises an upper surface, a lower surface, and a plurality of contacts, and the contacts are respectively at two sides of the upper surface and two sides of the lower surface of the circuit board and are electrically connected to the clamping sidewalls.

18. The electrical plug connector according to claim 17, wherein each of the clamping sidewalls comprises an upper hook portion, a lower hook portion, wherein a clamping space defined between the upper hook portion and the lower hook portion, the upper hook portion is opposite to the lower hook portion, the upper hook portion is abutted against the upper surface of the circuit board and the lower hook portion is abutted against the lower surface of the circuit board.

19. The electrical plug connector according to claim 18, wherein the upper hook portion and the lower hook portion are abutted against a rear surface of the circuit board.

* * * * *